US006083676A

United States Patent [19]

Chen et al.

[11] Patent Number: 6,083,676

[45] Date of Patent: Jul. 4, 2000

[54] METHOD FOR APPLYING A PROTECTIVE OVERCOAT TO A PHOTOGRAPHIC ELEMENT USING A FUSER BELT

[75] Inventors: Jiann H. Chen, Fairport; Stephen V. Davis, Rochester, both of N.Y.

[73] Assignee: Eastman Kodak Company, Rochester, N.Y.

[21] Appl. No.: 09/299,291

[22] Filed: Apr. 26, 1999

[51] Int. Cl.[7] ..... G03C 1/76

[52] U.S. Cl. ..... 430/523; 430/531; 432/59

[58] Field of Search ..... 430/523, 303, 430/531; 432/59

[56] References Cited

U.S. PATENT DOCUMENTS

| | | | |
|---|---|---|---|
| 2,173,480 | 9/1939 | Jung . | |
| 2,259,009 | 10/1941 | Talbot . | |
| 2,331,746 | 10/1943 | Talbot . | |
| 2,706,686 | 4/1955 | Hilborn . | |
| 2,798,004 | 7/1957 | Weigel . | |
| 3,113,867 | 12/1963 | Norman et al. . | |
| 3,190,197 | 6/1965 | Pinder . | |
| 3,397,980 | 8/1968 | Stone . | |
| 3,415,670 | 12/1968 | McDonald . | |
| 3,443,946 | 5/1969 | Grabhofer et al. . | |
| 3,502,501 | 3/1970 | Burczyk et al. . | |
| 3,697,277 | 10/1972 | King . | |
| 3,733,293 | 5/1973 | Gallagher . | |
| 3,810,735 | 5/1974 | Moser | 432/59 |
| 4,092,099 | 5/1978 | Chiba et al. | 432/59 |
| 4,092,173 | 5/1978 | Novak et al. . | |
| 4,171,979 | 10/1979 | Novak et al. . | |
| 4,279,945 | 7/1981 | Audran et al. . | |
| 4,302,523 | 11/1981 | Audran et al. . | |
| 4,333,998 | 6/1982 | Leszyk . | |
| 4,426,431 | 1/1984 | Harasta et al. . | |
| 4,639,405 | 1/1987 | Franke | 430/124 |
| 4,999,266 | 3/1991 | Platzer et al. . | |
| 5,089,363 | 2/1992 | Rimai et al. . | |
| 5,124,755 | 6/1992 | Hediger . | |
| 5,179,147 | 1/1993 | Jones . | |
| 5,200,284 | 4/1993 | Chen et al. . | |
| 5,233,008 | 8/1993 | Chen et al. . | |
| 5,330,840 | 7/1994 | Chen et al. . | |
| 5,362,833 | 11/1994 | Chen et al. | 528/25 |
| 5,386,281 | 1/1995 | Mitani et al. . | |
| 5,447,832 | 9/1995 | Wang et al. . | |
| 5,465,146 | 11/1995 | Higashi et al. . | |
| 5,529,847 | 6/1996 | Chen et al. . | |
| 5,804,341 | 9/1998 | Bohan et al. . | |
| 5,856,051 | 1/1999 | Yau et al. . | |

*Primary Examiner*—Janet Baxter
*Assistant Examiner*—Amanda C. Walke
*Attorney, Agent, or Firm*—Raymond L. Owens

[57] ABSTRACT

A method of forming a protective overcoat on a photographic element including the steps of providing a photographic element having a silver halide light-sensitive emulsion layer; applying a hydrophobic polymeric coating over the silver halide light sensitive emulsion layer; fusing the hydrophobic polymeric coating to the photographic element over the silver halide light sensitive emulsion layer to form a protective overcoat; by passing the photographic element through a nip formed between a heated fuser belt having a resin made by curing a composition including siloxanes and a roller to fuse the hydrophobic polymeric coating to the photographic element, wherein the siloxanes having a ratio of difunctional to trifunctional units of 1:1 to 1:2.7 and at least 90% of total number of functional units in the siloxanes are difunctional and trifunctional units, a weight average molecular weight of 5,000 to 50,000 grams/mole, and an alkyl to aryl ratio of 1:0.1 to 1:1.2.

20 Claims, 1 Drawing Sheet

METHOD FOR APPLYING A PROTECTIVE OVERCOAT TO A PHOTOGRAPHIC ELEMENT USING A FUSER BELT

FIELD OF THE INVENTION

This invention relates to providing a protective overcoat on a photographic element by using a fuser belt.

BACKGROUND OF THE INVENTION

Silver halide photographic elements contain light sensitive silver halide in a hydrophilic emulsion. An image is formed in the element by exposing the silver halide to light, or to other actinic radiation, and developing the exposed silver halide to reduce it to elemental silver.

In color photographic elements a dye image is formed as a consequence of silver halide development by one of several different processes. The most common is to allow a by-product of silver halide development, oxidized silver halide developing agent, to react with a dye forming compound called a coupler. The silver and unreacted silver halide are then removed from the photographic element, leaving a dye image.

In either case, formation of the image commonly involves liquid processing with aqueous solutions that must penetrate the surface of the element to come into contact with silver halide and coupler. Thus, gelatin, and similar natural or synthetic hydrophilic polymers, have proven to be the binders of choice for silver halide photographic elements. Unfortunately, when gelatin, and similar polymers, are formulated so as to facilitate contact between the silver halide crystal and aqueous processing solutions, they are not as tough and mar-resistant as would be desired for something that is handled in the way that an imaged photographic element may be handled. Thus, the imaged element can be easily marked by fingerprints, it can be scratched or torn and it can swell or otherwise deform when it is contacted with liquids.

There have been attempts over the years to provide protective layers for gelatin based photographic systems that will protect the images from damages by water or aqueous solutions. U.S. Pat. No. 2,173,480 describes a method of applying a colloidal suspension to moist film as the last step of photographic processing before drying. A series of patents describes methods of solvent coating a protective layer on the image after photographic processing is completed and are described in U.S. Pat. Nos. 2,259,009, 2,331,746, 2,798,004, 3,113,867, 3,190,197, 3,415,670 and 3,733,293. The application of UV-polymerizable monomers and oligomers on processed image followed by radiation exposure to form crosslinked protective layer is described U.S. Pat. Nos. 4,092,173, 4,171,979, 4,333,998 and 4,426,431. One drawback for the solvent coating method and the radiation cure method is the health and environmental concern of those chemicals to the coating operator. U.S. Pat. Nos. 3,397,980, 3,697,277 and 4,999,266 describe methods of laminating polymeric sheet film on the processed image as the protective layer. U.S. Pat. No. 5,447,832 describes the use of a protective layer containing mixture of high and low Tg latices as the water-resistance layer to preserve the antistat property of the V(2) O(5) layer through photographic processing. This protective layer is not applicable to the image formation layers since it will detrimentally inhibit the photographic processing. U.S. Pat. No. 2,706,686 describes the formation of a lacquer finish for photographic emulsions, with the aim of providing water- and fingerprint-resistance by coating the emulsion, prior to exposure, with a porous layer that has a high degree of water permeability to the processing solutions. After processing, the lacquer layer is fused and coalesced into a continuous, impervious coating. The porous layer is achieved by coating a mixture of a lacquer and a solid removable extender (ammonium carbonate), and removing the extender by sublimation or dissolution during processing. The overcoat as described is coated as a suspension in an organic solvent, and thus is not desirable for large-scale application. U.S. Pat. No. 3,443,946 provides a roughened (matte) scratch-protective layer, but not a water-impermeable one. U.S. Pat. No. 3,502,501 provides protection against mechanical damage only; the layer in question contains a majority of hydrophilic polymeric materials, and must be permeable to water in order to maintain processability. U.S. Pat. No. 5,179,147 likewise provides a layer that is not water-protective.

U.S. Pat. No 5,856,051 describes an aqueous coatable, water-resistant protective overcoat that can be incorporated into the photographic product, allows for appropriate diffusion of photographic processing solutions, and does not require coating operation after exposure and processing. This was accomplished by applying a coating comprising hydrophobic polymer particles having an average size of 0.01 to 1 microns to the silver halide light-sensitive emulsion layer. The silver halide light sensitive emulsion layer is developed to provide an imaged photographic element. The hydrophobic polymer particles are then fused to form a protective overcoat. This patent did not however describe the composition of any suitable materials for fusing the hydrophobic polymer particles to form the protective layer.

One key requirement of the method for fusing the particles comprising the protective overcoat is that the desired gloss level of the original unprotected photographic element be maintained. In the field of electrophotography, belt fusers have been shown to yield images with gloss values comparable to photographic elements. The belt in the belt fusing system can be made of stainless steel or polyester and the outer surface of the fuser member can be aluminum, steel, various alloys, or polymeric materials, such as, thermoset resins and fluoroelastomers.

The background art of electrophotography discloses several broad classes of materials useful for fuser belts. For example, U.S. Pat. Nos. 5,089,363; 5,465,146; 5,386,281; 5,362,833; 5,529,847; 5,330,840; 5,233,008; 5,200,284 and 5,124,755 disclose fuser belt systems consisting of belts coated with silicone polymers. U.S. Pat. No. 5,089,363 discloses that metal belts coated with highly crosslinked polysiloxanes provide fused toner images having high gloss.

Commonly-assigned U.S. Pat. No. 5,804,341 describes an electrostatically bound water-resistant protective overcoat that can be attached into the finished photographic product. This was accomplished by electrostatically binding a coating comprising hydrophobic polymer particles having an average size of 3 to 10 microns on to the silver halide light-sensitive emulsion layer after silver halide light sensitive emulsion layer is developed to provide an imaged photographic element. The hydrophobic polymer particles are then fused to form a protective overcoat.

Through the recent advances in the development of protective overcoats for photographic elements; further materials are required to fuse the particulate polymers composing the protective overcoats described in U.S. Pat. Nos. 5,856,051 and 5,804,341. These materials will be in the form of overcoated fusing belts which provide high gloss, longlife, and good release of the fused heat-softenable polymers images.

SUMMARY OF THE INVENTION

It is an object of the present invention to provide a method for forming protective overcoats on a photographic element.

This object is achieved by a method of forming a protective overcoat on a photographic element comprising the steps of;

(a) providing a photographic element having a silver halide light-sensitive emulsion layer;

(b) applying a hydrophobic polymeric coating over the silver halide light sensitive emulsion layer;

(c) fusing the hydrophobic polymeric coating to the photographic element over the silver halide light sensitive emulsion layer to form a protective overcoat; by:

passing the photographic element through a nip formed between a heated fuser belt having a resin made by curing a composition including siloxanes and a roller to fuse the hydrophobic polymeric coating to the photographic element, wherein the siloxanes having a ratio of difunctional to trifunctional units of 1:1 to 1:2.7 and at least 90% of total number of functional units in the siloxanes are difunctional and trifunctional units, a weight average molecular weight of 5,000 to 50,000 grams/mole, and an alkyl to aryl ratio of 1:0.1 to 1:1.2.

The present invention provides a fuser belt comprising a substrate and a coating on the substrate, the coating comprises a resin made by curing a composition comprising siloxanes having a ratio of difunctional to trifunctional units of 1:1 to 1:2.7 and at least 90% of total number of functional units of the siloxanes are difunctional and trifunctional units, a weight average molecular weight of 5,000 to 50,000, and an alkyl to aryl ratio of 1:0.1 to 1:1.2. The prior art does not however describe the composition of any suitable materials for fusing the hydrophobic polymer particles to form the protective layer. The present invention provides suitable materials to form the protective layer.

This fuser belt provides high gloss, long-life, and good release of the fused for heat-fixing a heat-softenable polymer being a protective overcoat for a photographic elements. The protective overcoat having been formed by the steps of providing a photographic element having at least one silver halide light-sensitive emulsion layer; applying a coating comprising hydrophobic polymer particles having an average size of 0.01 to 1 microns, over the at least one silver halide light-sensitive emulsion layer. The silver halide light sensitive emulsion layer is developed to provide an imaged photographic element. The hydrophobic polymer particles are then fused to form a protective overcoat. In an alternate hydrophobic polymer particles having an average size of 3 to 10 microns arc electrostatically bound to the outer emulsion layer.

DETAILED DESCRIPTION OF THE INVENTION

Figure 1:
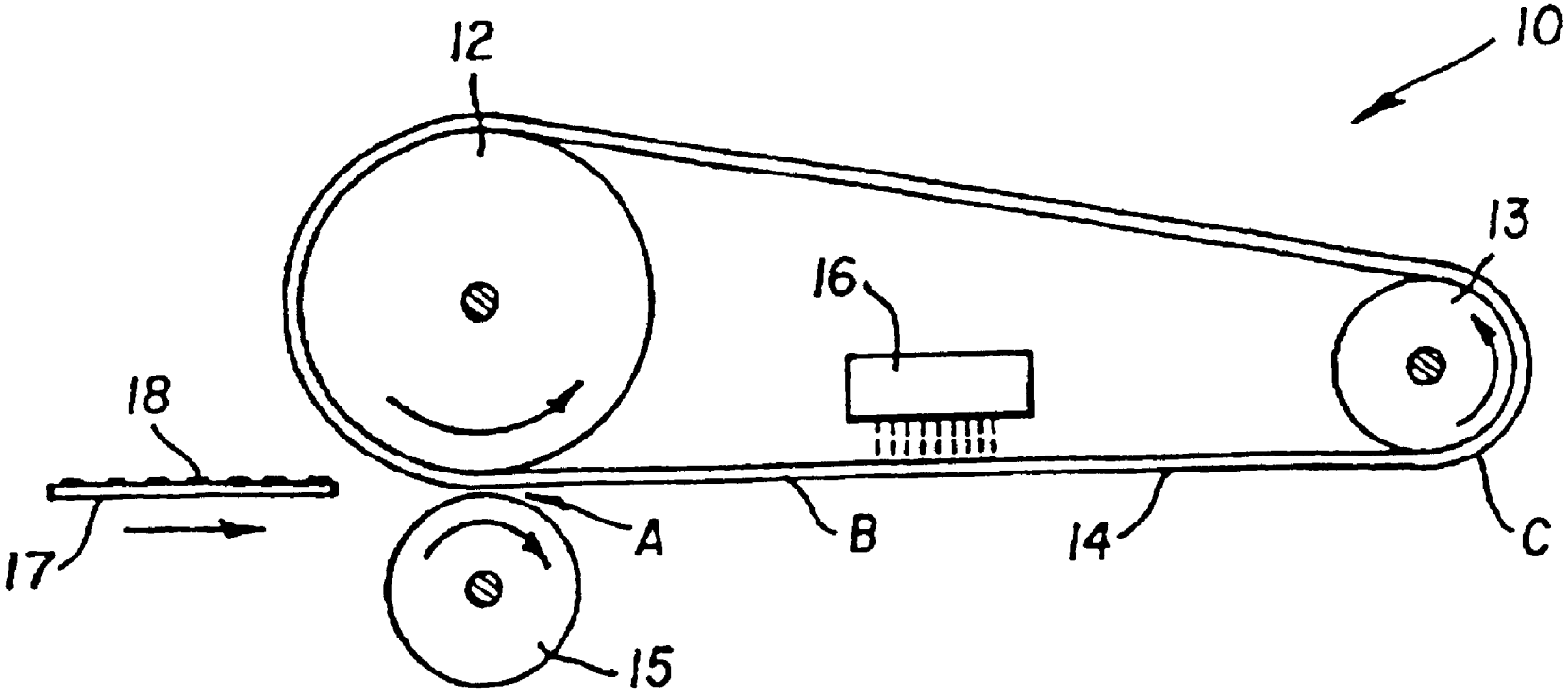
FIG. 1 shows a system including a fuser belt for fixing a protective coating to a photographic element.

The fuser belt of this invention comprises a substrate over which a coating comprising a silicone resin is coated. The substrate can comprise metal, such as, stainless steel, steel, nickel, copper, and chrome, or a polymer, such as, polyimide, polyester, polycarbonate, and polyamide, or mixtures or combinations of the listed materials. The substrate can be a smooth sheet or a meshed material, preferably it is a smooth sheet. The substrate is preferably a seamless endless belt; however, belts having seams can also be used. The thickness of the substrate is preferably 50 to 200 micrometers, more preferably 50 to 100 micrometers and most preferably 50 to 75 micrometers.

The silicone resins in the coating on the substrate can comprise monofunctional, difunctional, trifunctional and tetrafunctional units or units having mixtures of these functionalities. Monofunctional units can be represented by the formula —$(R)_3SiO_{0.5}$—. Difunctional units can be represented by the formula —$(R)_2SiO$—. Trifunctional units can be represented by the formula —$RSiO_{0.5}$—. Tetrafunctional units can be represented by the formula —$SiO_2$—. R in the formulas independently represents alkyl groups preferably having from 1 to 8 carbons, more preferably 1 to 5 carbons or aryl groups preferably having 4 to 10 carbons in the ring(s), more preferably 6 carbons in the ring(s). The siloxanes used to form the silicone resin comprise at least some R groups which are alkyl groups, and some R groups which are aryl groups. Mixtures of different alkyl groups and different aryl groups may be present in the siloxanes. The alkyl and all groups can comprise additional substituents and heteroatoms, such as, halogens, in for example a fluoropropyl group, and alkyl groups, in for example a methylphenyl group. The alkyl groups are preferably methyl, ethyl, propyl, isopropyl, butyl, isobutyl, tert-butyl, pentyl, more preferably methyl, ethyl, propyl, and isopropyl, most preferably methyl. The aryl groups are preferably phenyl, diphenyl, or benzyl, more preferably phenyl. The silicone resins have an alkyl to aryl ratio of 1:0.1 to 1:1.2; more preferably 1:0.3 to 1:1.0; most preferably 1:0.4 to 1:0.9. The silicone resin has a ratio of difunctional to trifunctional units of 1:1to 1:2.7, more preferably 1:1.5 to 1:2.5, most preferably 1:1.8 to 1:2.3 and at least 90% of total number of functional units in the silicone resin are difunctional and trifunctional units, more preferably at least 95% of total number of functional units in the silicone resin are difunctional and trifunctional units, most preferably at least 98% of total number of functional units in the silicone resin are difunctional and trifunctional units. The preferred silicone resins comprise substantially only difunctional, trifunctional and tetrafunctional units, meaning that the preferred silicone resins comprise less than 1% monofunctional units of the total number of functional units in the silicone resin. The most preferred silicone resins comprise substantially only difunctional and trifunctional units, meaning that the most preferred silicone resins comprise less than 1% monofunctional and tetrafunctional units of total number of functional units in the silicone resin. The percentages of the functionalities in the silicone resin can be determined using $S^{29}$) NMR.

The silicone resin is made by curing a composition comprising siloxanes. Siloxanes can be monofunctional, difunctional, trifunctional and/or tetrafunctional silicone polymers. The siloxanes are preferably hydroxy-terminated silicone polymers or have at least two hydroxy groups per siloxane. The weight average molecular weight of the siloxanes used to make the thermoset silicone resin is preferably 5,000 to 50,000 grams/mole (g/mol), more preferably 6,000 to 30,000 g/mol, most preferably 7,500 to 15,000 g/mol. Even more preferred are siloxanes having a weight average molecular weight of 7,500 to 10,000 g/mol, and more preferably 7,500 to 8,500. The weight average molecular weight is determined by Size Exclusion Chromatography (SEC). Once the silicone resin is cured, typically by thermosciting, it is difficult to determine the weight average molecular weight of the siloxanes used to form the silicone resin; however, the functional units and alkyl to aryl ratio of the siloxanes will be the same for the silicone resin and the siloxanes used to make the silicone resin.

The silicone resin which is preferably highly crosslinked can be prepared as described in numerous publications. The silicone resins used in this invention are hard, brittle, and highly crosslinked, as compared to silicone elastomers which are deformable, elastic, and highly crosslinked. One method to form the silicone resin is by a condensation reaction as described in, for example, D. Sats, Handbook of Pressure Sensitive Adhesive Technology, 2nd Ed., pp. 601–609, Van Nostrand Reinhold (1989). Other references which disclose the preparation of these highly crosslinked silicone resins are Kirk-Othmer, Encyclopedia of Chemical Technology, 3rd Ed., Vol. 20, pp. 940–962; and Lichtenwalner and Sprung, Bikales, Ed., Encyclopedia of Polymer Science and Technology, Vol. 12, Interscience Publishers, (New York 1970) pg. 464. Useful silicone resins are commercially available, such as, DM 30036 and DM 30020 available from Acheson Colloids Company, and DC-253 1 available from Dow Corning.

The fuser belt coating can comprise fillers. It is preferred that the fillers, if present are at an amount less than 3%, more preferably less than 1%, to maintain a smooth surface of the coating on the fuser belt. Examples of useful fillers include aluminum, silica, and copper. The preferred fuser belts of this invention have coatings which do not contain fillers, that is, they are non-filled coatings. The non-filled coatings are preferred, because typically they produce fused toner images having higher gloss.

The thickness of the silicone resin coating on the belt is preferably less than 50 micrometers, preferably 1 to 25 micrometers, most preferably 1 to 15 micrometers. Additional layers can be present on the fuser belt if desired. It is preferred that the surface energy of the coating is 20 to 30 milliJoules/meter(^2) or less, because low surface energy belts provide better release of toner without the addition of release oils. The fuser belt preferably provides a surface finish of the fused heat-softenable polymer being a protective overcoat for a photographic elements layer of G-20 gloss greater than 70, preferably greater than 80, most preferably greater than 90. The gloss measurements can be determined using a BYK Gardner micro glossmeter set at 20 degrees by the method described in ASTM-523-67.

The substrates of the fuser belts are preferably solvent cleaned prior to coating the substrates with the release coating. The release coatings are preferably prepared by making a solvent solution comprising the siloxanes and coating the solution onto the clean substrate by conventional coating techniques, such as, ring coating, dip coating, and spray coating. After coating the substrates with the release coating solution, the coated substrates are preferably placed in a convection oven at a temperature of 150 deg. C. to 350 deg. C., for 10 minutes to 3 hours, preferably causing the siloxanes to undergo condensation reactions to form the silicone resin. The higher the cure temperature the shorter the cure time.

It may be desirable to use primer, adhesion promoters or other layers between the substrate and the silicone resin coating of the fuser belt. For example, silane primers, and functionalized silane primers can be applied to the substrate, prior to the application of the release coating. Examples of commercially available primers are Dow Corning DC1200, and Petrarch A0700 and A0698.

Fuser belts of this invention can be any size and can be used in any fuser belt system which comprises a fuser belt. Preferably the fuser belt system comprises a fuser belt which is trained around two or more rollers, and is in pressurized contact with another fuser member, preferably either another fuser belt or a fuser roller. Fuser belts of this invention can be used to contact the heat-softenable polymer being a protective overcoat for a photographic elements.

The photographic elements in which the images to be protected are formed can have the structures and components shown in Research Disclosure 37038. Specific photographic elements can be those shown on pages 96–98 of Research Disclosure 37038 as Color Paper Elements 1 and 2. A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. All of these can be coated on a support which can be transparent (for example, a film support) or reflective (for example, a paper support). Photographic elements protected in accordance with the present invention may also include a magnetic recording material as described in Research Disclosure, Item 34390, November 1992, or a transparent magnetic recording layer such as a layer containing magnetic particles on the underside of a transparent support as described in U.S. Pat. No. 4,279,945 and U.S. Pat. No. 4,302,523.

Suitable silver halide emulsions and their preparation, as well as methods of chemical and spectral sensitization, are described in Sections I through V of Research Disclosure 37038. Color materials and development modifiers are described in Sections V through XX of Research Disclosure 37038. Vehicles are described in Section II of Research Disclosure 37038, and various additives such as brighteners, antifoggants, stabilizers, light absorbing and scattering materials, hardeners, coating aids, plasticizers, lubricants and matting agents are described in Sections VI through X and XI through XIV of Research Disclosure 37038. Processing methods and agents are described in Sections XIX and XX of Research Disclosure 37038, and methods of exposure are described in Section XVI of Research Disclosure 37038.

Photographic elements typically provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like). Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like.

Photographic elements can be imagewise exposed using a variety of techniques. Typically exposure is to light in the visible region of the spectrum, and typically is of a live image through a lens. Exposure can also be to a stored image (such as a computer stored image) by means of light emitting devices (such as LEDs, CRTs, etc.).

Images can be developed in photographic elements in any of a number of well known photographic processes utilizing any of a number of well known processing compositions, described, for example, in T. H. James, editor, The Theory of the Photographic Process, 4th Edition, Macmillan, New York, 1977. In the case of processing a color negative element, the element is treated with a color developer (that is one which will form the colored image dyes with the color couplers), and then with an oxidizer and a solvent to remove silver and silver halide. In the case of processing a color reversal element, the element is first treated with a black and white developer (that is, a developer which does not form colored dyes with the coupler compounds) followed by a treatment to render developable unexposed silver halide (usually chemical or light fogging), followed by treatment with a color developer. Development is followed by bleach-fixing, to remove silver or silver halide, washing and drying.

FIG. 1 illustrates the preferred configuration of a fuser belt system 10 using a fuser belt 14 of this invention. The fuser belt system 10 comprises a heating roller 12, and roller 13 around which fuser belt 14 is trained which is conveyed in the direction indicated on rollers 12 and 13 in FIG. 1. Backup roller 15 is biased against the heating roller 12. The fuser belt 14 is cooled by impinging air provided by blower 16 disposed above fuser belt 14. In operation, receiver 17 bearing the unfused toner 18 is transported in the direction of the arrow into the nip between heating roller 12 and backup roller 15, which can also or alternatively be heated if desired, where it enters a fusing zone A extending about 0.25 to 2.5 cm, preferably about 0.6 cm laterally along the fuser belt 14. Following fusing in the fusing zone A, the fused image then continues along the path of the belt 14 and into the cooling zone B about 5 to 50 cm in length in the region after the fusing zone A and to roller 13. In the cooling zone B, belt 14 is cooled slightly upon separation from heating roller 12 and then additionally cooled in a controlled manner by air that is caused to impinge upon belt 14 as the belt passes around roller 13 and is transported to copy collection means such as a tray (not shown). Support 17 bearing the fused image is separated from the fuser belt 14 within the release zone C at a temperature where no toner image offset occurs. Separation is expedited by using a roller 13 of relatively small diameter, e.g. a diameter of about 2.5 to 4 cm. As a result of passing through the three distinct zones, i.e. the fusing zone A, cooling zone B and release zone C, the fused toner image exhibits high gloss. The extent of each of the three zones and the duration of the time the toner image resides in each zone can be conveniently controlled simply by adjusting the velocity or speed of belt 14. The velocity of the belt in a specific situation will depend on several variables, including, for example, the temperature of the belt in the fusing zone A, the temperature of the cooling air in the cooling zone B, and the composition of the toner particles.

The invention will be better understood with reference to the following examples:

EXAMPLES

Example 1

A polyimide belt 2 mil (50 micrometers) thick, 7.6 inch (19.2 cm) diameter, and 7.5 inch (19.0 cm) wide was obtained from Gunze Co. The belt was coated with Acheson DM 30036 silicone thermoset resin by the following process. The belt was wiped with dichloromethane followed by acetone and ethanol and then allowed to air dry. The belt was first ring coated with Witcobond 232 a high temperature stable polyurethane obtained from Witco Corp. as a primer and allowed to air dry. The belt was then ring coated with an Acheson Colloid DM 30036 solution (44% solids) diluted 2:1 with Naphtha. The belt was allowed to air dry and then were cured in a forced air oven by ramping the temperature from ambient to 200 deg. C. over a period of 1 hour followed by a 2 hour curing period at 200 deg. C. The DM-30036 highly crosslinked silicone resin had a dry coating thickness of approximately 1.5 micrometers. The Alkyl:Aryl Ratio, the D:T Ratio, and the weight average molecular weight of the siloxanes for DM-30036 are listed in Table 1. The belt was tested as described below and the results are in Table 1.

Example 2

A second belt was prepared as in Example 1. The belt was tested as described below and the results are in Table 2.

Comparative Example 1

A polyimide belt as described in Example 1 was prepared by the following process. The belt was wiped with dichloromethane followed by acetone and ethanol and then allowed to air dry. The belt was tested as described below and the results are in Table 1.

Comparative Example 2

A polyamide belt made of Kapton® from Dupont was prepared by the following process. The belt was wiped with dichloromethane followed by acetone and ethanol and then allowed to air dry. The belt was tested as described below and the results are in Table 1.

Comparative Example 3

A second belt was prepared as in Comparative Example 1. The belt was tested as described below and the results are in Table 2.

Comparative Example 4

A second belt was prepared as in Comparative Example 2. The belt was tested as described below and the results are in Table 2.

Test for Water Resistance

In the case of applying a coating comprising hydrophobic polymer particles having an average size of 0.01 to 1 microns, over the at least one silver halide light-sensitive emulsion layer, the examples and counter examples were screened as to their ability to form the particulate hydrophobic polymer into a uniform continuous film. Receivers were photographic elements made according to U.S. Pat. No. 5,856,051. These photographic element were then fused with the examples and counterexamples indicated. Results are shown in the Table 1 below. Ponceau Red dye is known to stain gelatin through ionic interaction, therefore it is used to test water resistance. Ponceau red dye solution was prepared by dissolving 1 gram dye in 1000 grams mixture of acetic acid and water (5 parts: 95 parts). Samples, without being exposed to light, were processed through the Kodak RA4 process to obtain white Dmin samples. These processed samples were then passed through a set of heated pressurized rollers (fusing) to convert the polymer particles of the overcoat into a water resistant layer. The water permeability was done by soaking fused samples in the dye solution for 5 minutes followed by a 30-second water rinse to removed excess dye solution on the coating surface. Each sample was then air dried, and status A reflectance density on the soaked area was recorded.

TABLE 1

| Sample # | 125° C. Fusing Temperature | 130° C. Fusing Temperature | 135° C. Fusing Temperature |
|---|---|---|---|
| E1 | Resistant | Resistant | Resistant |
| CE1 | Nonresistant | Resistant | Nonresistant |
| CE2 | Nonresistant | Resistant | Resistant |

Test for Fusing Electrostatically Bound Polymer

In the case of binding hydrophobic polymer particles having an average size of 3 to 10 microns electrostatically to the outer emulsion layer over the at least one silver halide light-sensitive emulsion layer, the examples and counter examples were screened as to their ability to release the particulate hydrophobic polymer. Receivers were laserprint paper having polyester toner electrostatically bound to its surface at a laydown of 0.8mg/cm$^2$. The response measured was belt life and image Gloss on a Gardner scale at a 20° angle (G20).

These fuser belts were mounted on a fuser system like the one shown in FIG. 1 and run at 155° C. to 138° C. fusing temperature and 35° C. to 46° C. release temperature against a Silastic J (available from Dow Corning) coated pressure roller at a nip load of approximately 15 kg/cm. Fusing speed was 3.5 cm/s to 4 cm/s. The nip width was 0.6 cm. Blank sheets of Pliotone/Piccotex (70/30) coated paper were used wih toned prints intersperded at 200 print intervals. The life tests were terminated when toner or receiver offset onto the belt surface, when localized areas of the belt coating delaminated, or after 20,000 prints. The life test and image gloss results as summarized below. Gloss measurements were made according to ASTM-523-67 using a BYK Gardner Micro Gloss Meter set at 20°.

TABLE 2

| Sample # | Gloss (G20) | Belt Life |
|---|---|---|
| E2 | >90 | >20,000 |
| CE3 | >90 | <100 |
| CE4 | >90 | <100 |

These Examples and Comparative Examples illustrate the benefits of this invention. Table 1 indicates that the fuser belts having the silicone resin coatings of the invention have excellent water resistance without detrimentally affecting the image gloss. Comparative Examples 1 and 2 which are uncoated belts provide less water resistance. Table 2 indicates that the fusing belt had a long life and acceptable gloss.

The invention has been described with reference to particular embodiments, but it is appreciated that variations and modifications can be effected within the spirit and scope of the invention.

What is claimed is:

1. A method of forming a protective overcoat on a photographic element comprising the steps of;

(a) providing a photographic element having a silver halide light-sensitive emulsion layer;

(b) applying a hydrophobic polymeric coating over the silver halide light sensitive emulsion layer;

(c) fusing the hydrophobic polymeric coating to the photographic element over the silver halide light sensitive emulsion layer to form a protective overcoat; by:

passing the photographic element through a nip formed between a heated fuser belt having a resin made by curing a composition including siloxanes and a roller to fuse the hydrophobic polymeric coating to the photographic element, wherein the siloxanes having a ratio of difunctional to trifunctional units of 1:1 to 1:2.7 and at least 90% of total number of functional units in the siloxanes are difunctional and trifunctional units, a weight average molecular weight of 5,000 to 50,000 grams/mole, and an alkyl to aryl ratio of 1:0.1 to 1:1.2.

2. The method of claim 1 wherein the ratio of difunctional to trifunctional units is 1:1.5 to 1:2.5.

3. The method of claim 1 wherein the ratio of difunctional to trifunctional units is 1:1.8 to 1:2.3.

4. The method of claim 1 wherein the alkyl to aryl ratio is 1:0.3 to 1:1.0.

5. The method of claim 1 wherein the alkyl to aryl ratio is 1:0.4 to 1:0.9.

6. The method of claim 1 wherein the weight average molecular weight is 6,000 to 30,000 grams/mole.

7. The method of claim 1 wherein the weight average molecular weight is 7,500 to 15,000 grams/mole.

8. The method of claim 1 wherein the alkyl groups are methyl and the aryl groups are phenyl.

9. The method of claim 1 wherein the siloxanes are hydroxy-terminated.

10. The method of claim 1 which produces fused images having a G-20 gloss of greater than 70.

11. The method of claim 1 having a surface energy of 20 to 30 milliJoules/meter(^2).

12. The method of claim 1 wherein the siloxanes comprise less than 1% monofunctional units of total number of functional units in the siloxanes.

13. The method of claim 1 wherein the siloxanes comprise less than 1% monofunctional and tetrafunctional units of total number of functional units in the siloxanes.

14. The method of claim 1 wherein the ratio of difunctional to trifunctional units is 1:1.5 to 1:2.5 and at least 95% of total number of functional units in the silicone resin are difunctional and trifunctional units, the weight average molecular weight is 7,500 to 10,000 grams/mole, and the alkyl to aryl ratio is 1:0.1 to 1:1.2.

15. The method of claim 14 wherein the ratio of difunctional to trifunctional units is 1:1.8 to 1:2.3.

16. The method of claim 14 wherein the alkyl to aryl ratio is 1:0.3 to 1:1.0.

17. The method of claim 14 wherein the alkyl to aryl ratio is 1:0.4 to 1:0.9.

18. The method comprising a substrate and a coating on the substrate, the coating comprises a resin made by curing a composition comprising siloxanes having a ratio of difunctional to trifunctional units of 1:1.8 to 1:2.3 and at least 98% of total number of functional units in the siloxanes are difunctional and trifunctional units, a weight average molecular weight of 7,500 to 8,500 grams/mole, and an alkyl to aryl ratio of 1:0.4 to 1:0.9.

19. A method of fusing a hydrophobic polymeric coating to the silver halide light sensitive emulsion layer to form a protective overcoat; by:

passing the photographic element through a nip formed between a heated fuser belt having a resin made by curing a composition including siloxanes and a roller to fuse the hydrophobic polymeric coating to the photographic element, wherein the siloxanes having a ratio of difunctional to trifunctional units of 1:1 to 1:2.7 and at least 90% of total number of functional units in the siloxanes are difunctional and trifunctional units, a weight average molecular weight of 5,000 to 50,000 grams/mole, and an alkyl to aryl ratio of 1:0.1 to 1:1.2;

cooling the fuser belt in contact with the photographic element; and releasing the photographic element from the fuser belt.

20. The method of claim 19 wherein the fixed photographic element is water resistant image has a G-20 gloss of greater than 70.

* * * * *